US007521640B2

(12) United States Patent
Kodama et al.

(10) Patent No.: US 7,521,640 B2
(45) Date of Patent: Apr. 21, 2009

(54) DIAL-TYPE MANIPULATOR HAVING MARK FOR CONFIRMING CORRECT ENGAGING POSITION OF GEARS

(75) Inventors: Masami Kodama, Nagoya (JP); Satoshi Nakazono, Handa (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 11/711,911

(22) Filed: Feb. 27, 2007

(65) Prior Publication Data

US 2007/0251442 A1 Nov. 1, 2007

(30) Foreign Application Priority Data

Apr. 28, 2006 (JP) ..... 2006-126158

(51) Int. Cl.
*H01H 3/08* (2006.01)
*H01H 19/00* (2006.01)

(52) U.S. Cl. ..... 200/336; 200/564

(58) Field of Classification Search ..... 200/336, 200/315

See application file for complete search history.

(56) References Cited

U.S. PATENT DOCUMENTS 5,159,706 A * 10/1992 Hodsdon ..... 455/90.3
7,342,186 B2 * 3/2008 Montalvo et al. ..... 200/11 R
2003/0182809 A1 * 10/2003 Enzinna ..... 33/1 PT

FOREIGN PATENT DOCUMENTS

| | | |
|---|---|---|
| JP | 05-341351 | 12/1993 |
| JP | 10-268955 | 10/1998 |
| JP | 2000-067696 | 3/2000 |
| JP | 2001-184969 | 7/2001 |
| JP | 2003-014058 | 1/2003 |

* cited by examiner

*Primary Examiner*—Elvin G Enad
*Assistant Examiner*—Lheiren Mae A Anglo
(74) *Attorney, Agent, or Firm*—Harness, Dickey & Pierce, PLC

(57) ABSTRACT

A dial-type manipulator is used to manipulate devices mounted on an automobile, such as an air-conditioner, an audio system or a navigation system. The dial-type manipulator includes a first gear formed on an outer periphery of a dial member and a second gear engaging with the first gear. A detector such as a rotary resistor is driven by the second gear to detect a rotational position of the dial member. A position holder for holding the first gear at a predetermined reference position is provided in the manipulator. A confirmation mark such as a groove or a rib mark is formed on the front surface of the second gear. The confirmation mark is visible from a front side of the manipulator at a position along an outer periphery of a dial member when the dial member is rotated and held at the reference position, if the first gear engages with the second gear at a predetermined correct position. If the gears are not correctly engaged, the confirmation mark is located at other positions.

16 Claims, 5 Drawing Sheets

DIAL-TYPE MANIPULATOR HAVING MARK FOR CONFIRMING CORRECT ENGAGING POSITION OF GEARS

CROSS-REFERENCE TO RELATED APPLICATION

This application is based upon and claims benefit of priority of Japanese Patent Application No. 2006-126158 filed on Apr. 28, 2006, the content of which is incorporated herein by reference.

BACKGROUND OF THE INVENTION

1. Field of the Invention

The present invention relates to a dial-type manipulator for manipulating devices mounted on an automotive vehicle, such as an air-conditioner, an audio system or a navigation system.

2. Description of Related Art

The on-board devices, such as an air-amount adjuster, a temperature setter or an air-outlet selector of an air-conditioner, are often manipulated by a dial-type manipulator mounted on a dashboard. An output volume of an on-board audio system may be controlled by the dial-type manipulator. Examples of dial-type manipulators are disclosed in JP-A-2000-67696 and JP-A-2001-184969. In these dial-type manipulators, a large gear is connected to an outer periphery of a dial member, and a rotational position detector such as a rotary resistor is driven by a small gear engaging with the large gear.

In a process of assembling the dial-type manipulator, the large gear has to be engaged with the small gear at a correct rotational position. It is not easy, however, to assemble the gears at the correct engaging position by manual operation. If both gears are not assembled AT the correct rotational position, the rotational position detector is not correctly rotated to a desired position. This means that the on-board devices are not manipulated as intended.

SUMMARY OF THE INVENTION

The present invention has been made in view of the above-mentioned problem, and an object of the present invention is to provide an improved dial-type manipulator, in which a correct engaging position of gears is easily confirmed in an assembling process, thereby avoiding errors in the engaging position.

The dial-type manipulator according to the present invention includes a dial member having a first gear formed on its outer periphery, a second gear engaging with the first gear and a position holder for holding the first gear at a predetermined reference position. The dial member is rotatably supported on a base member, and the position holder is supported on the base member so that it resiliently engages with the first gear at the reference position. A confirmation mark is formed on either the second gear or a dial member so that it is visible from the front side of the dial-type manipulator. A detector such as a rotary resistor is connected to and driven by the second gear to detect a rotational position of the dial member.

The confirmation mark is formed, for example, on the front surface of the second gear in a shape of a groove or a rib. When the second gear is made of a resin material by molding, the confirmation mark may be formed integrally with the second gear. The confirmation mark such as a line mark on the second gear is positioned exactly along an outer periphery of a flange formed on the dial member when the dial member is rotated to the reference position, if the second gear is engaged with the first gear at a predetermined correct position. If the gears are not engaged at the correct position, the confirmation mark moves to another position. In this manner, whether or not the gears are correctly engaged with each other is easily confirmed in the assembling process.

The confirmation mark may be variously modified. For example, it may be made as a colored region, a light-reflecting mark or the like. The confirmation mark may be formed on the flange of the dial member, or on both of the second gear and the flange. The position holder may resiliently engage with the first gear at its plural rotational positions. In this case, it is preferable to make the plural positions apart from one another by more than two-tooth pitch of the first gear, most preferably by more than four-tooth pitch. In this manner, whether the gears are correctly engaged or not is much easily confirmed by positions of the confirmation mark.

Whether or not the first gear engages with the second gear at a predetermined correct position is easily confirmed by simply forming the confirmation mark according to the present invention. Thus, devices are correctly manipulated by the dial-type manipulator. Other objects and features of the present invention will become more readily apparent from a better understanding of the preferred embodiment described below with reference to the following drawings.

DETAILED DESCRIPTION OF THE PREFERRED EMBODIMENT

Figure 1:
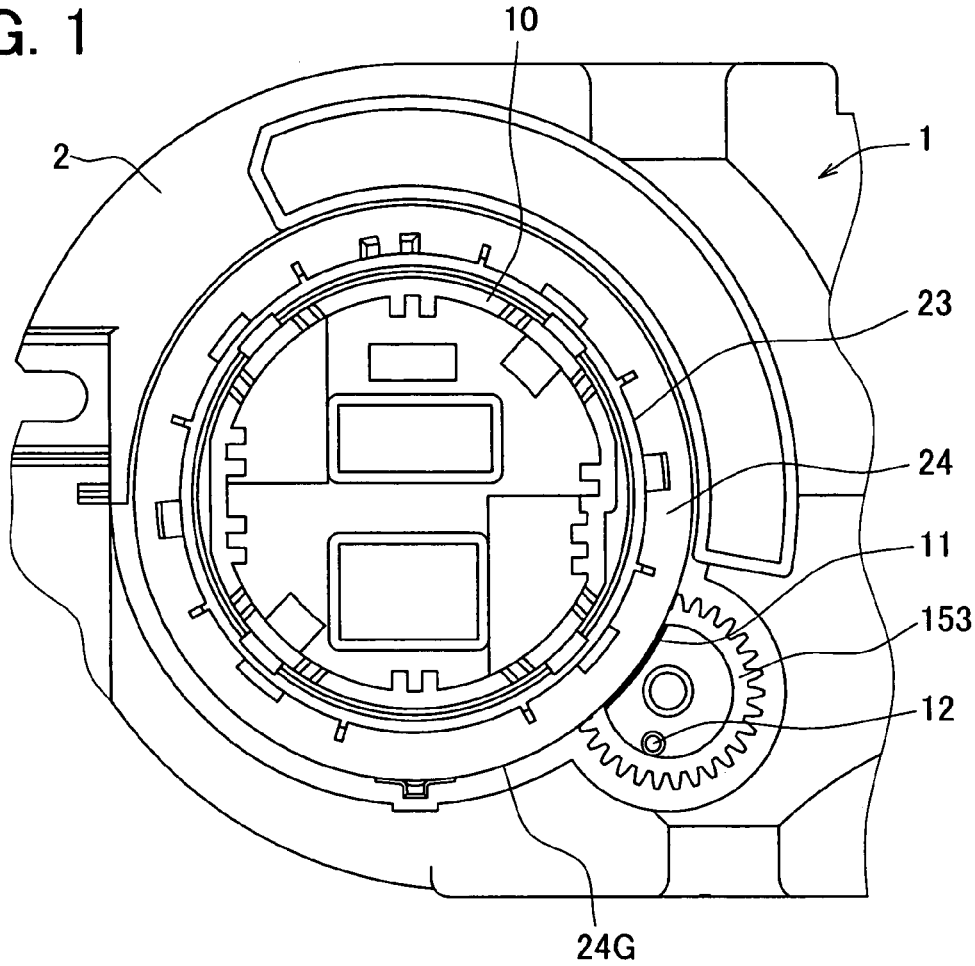
FIG. 1 is a plan view showing a dial-type manipulator according to the present invention.
Figure 2:
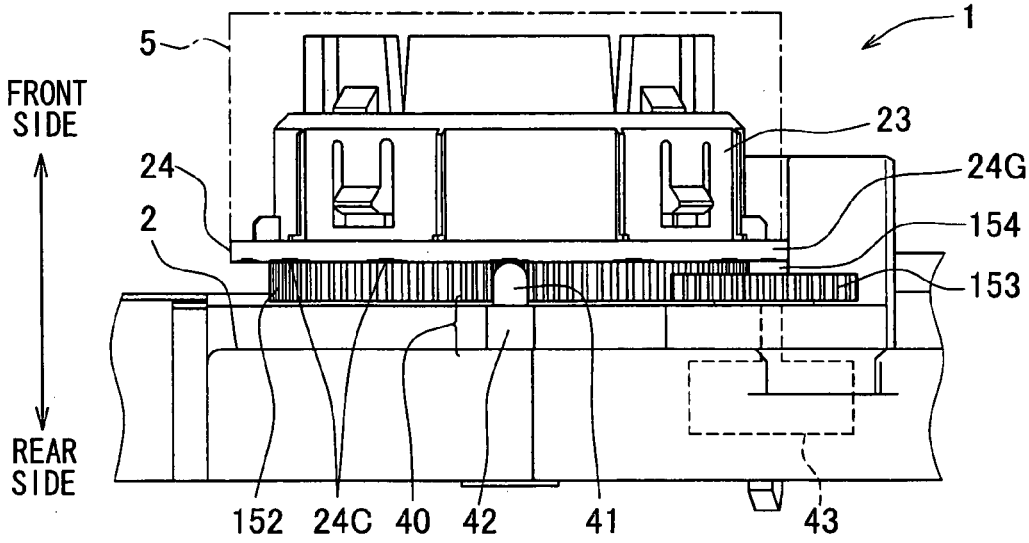
FIG. 2 is a side view showing the dial-type manipulator.

A preferred embodiment of the present invention will be described with reference to accompanying drawings. First, referring to FIGS. 1 and 2, a structure of a dial-type manipulator 1 will be described. The dial-type manipulator 1 includes: a dial member 23 having a first gear 152 formed around the dial member 23; a second gear 153 engaging with the first gear 152; a detector 43, coaxially connected to the second gear 153, for detecting a rotational position of the dial member 23; and a position holder 40 for holding a rotational position of the first gear 152. The detector 43 may be a rotary variable resistor, a resistance of which changes according to rotation of the second gear 153.

A flange 24 is formed around the dial member 23, covering the first gear 152 and a portion of the second gear 153 not to visible from the front side of the dial-type manipulator 1. The dial member 23 is disposed on a base member 2 and rotatably supported around a cylindrical member 10 formed on the base member 2. A cover 5 rotating together with the dial member 23 is disposed around the dial member 23. Depressions 24C are formed on a rear surface of the flange 24 at an interval larger than two-tooth pitch of the first gear 152. Preferably, the interval between the neighboring depressions 24C is made larger than 3-tooth pitch (most preferably larger than 4-tooth pitch).

The position holder 40 is composed of a supporter 42 formed on the base member 2 and a projected portion 41. The projected portion 41 is biased upward by a resilient member such as a spring disposed in the supporter 42, so that projected portion 41 resiliently engages with one of the depressions 24C formed on the rear surface of the flange 24. When the dial member 23 is rotated, the projected member 41 is pushed against the rear surface of the flange 24 and engages snapwise with one of the depressions 24C.

A confirmation mark 11 is formed on a front surface of the second gear 153. The confirmation mark 11 is visible from the front side exactly along an outer periphery 24G of the flange 24 when the dial member 23 is rotated to a predetermined reference position and stopped there by the position holder 40, if the first gear 152 and the second gear 153 are assembled to engage with each other at a correct position. In this case, the confirmation mark 11 is positioned exactly along the outer periphery 24G of the flange, as better seen in FIG. 5. If two gears do not correctly engage, the confirmation mark 11 takes a position different from that shown in FIG. 5, which will be described later in detail.

If the position holder 40 holds the position of the first gear 152 at every tooth pitch, a small displacement of the confirmation mark 11 from the correct position can be easily adjusted by rotating the dial member 23 by a small rotational angle. This would lead to a misjudgement that the gears are correctly engaged even if they are not correctly engaged. However, the depressions 24C are formed at an interval of more than the two-tooth pitch of the first gear 152 in the embodiment of the present invention. Therefore, the dial member 23 has to be rotated by more than the two-tooth pitch from the reference position in order to place the confirmation mark 11 at the correct position (the position exactly along the outer periphery 24G of the flange 24) if the gears are not correctly engaged. In this manner, the misjudgement is avoided.

Figure 3C:
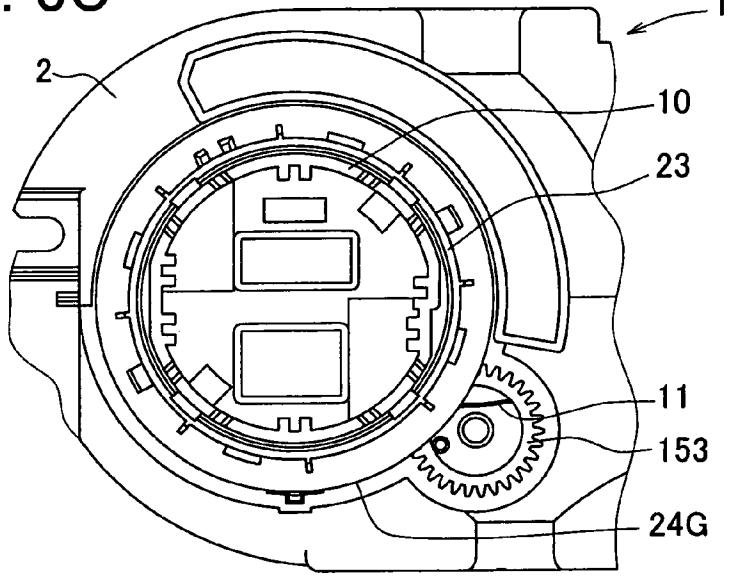
FIGS. 3A-3D are drawings for explaining a function of a confirmation mark for assembling gears at a correct engaging position, wherein 3A and 3C are plan views and 3B and 3D are side views.
Figure 3A:
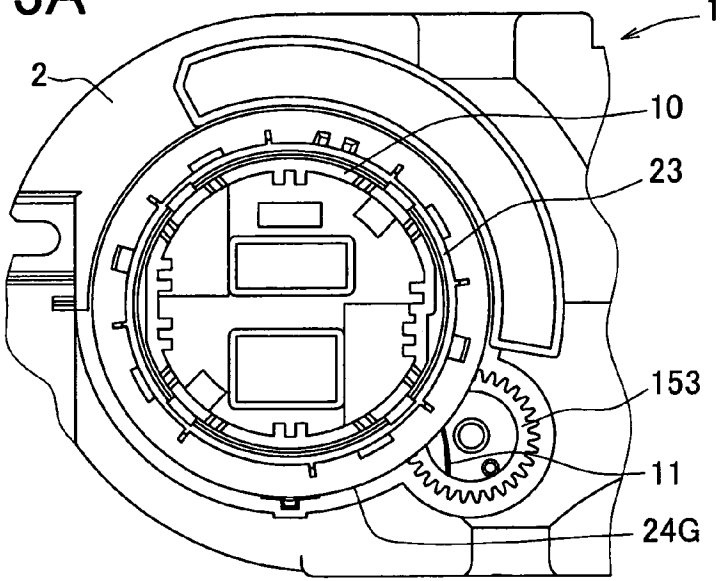
Figure 3D:
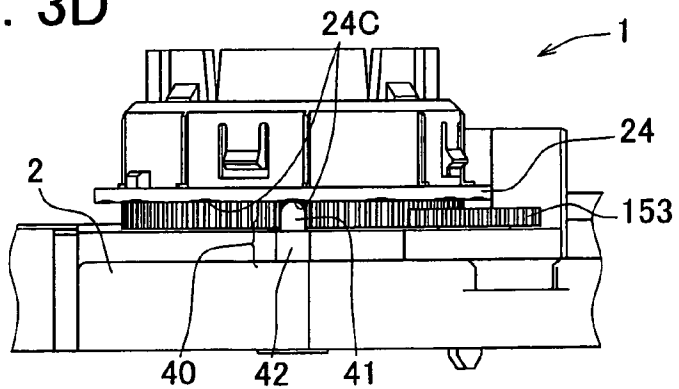
Figure 3B:
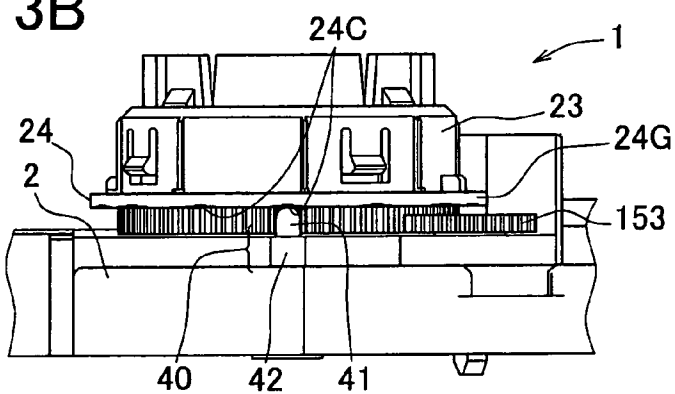
Figure 4C:
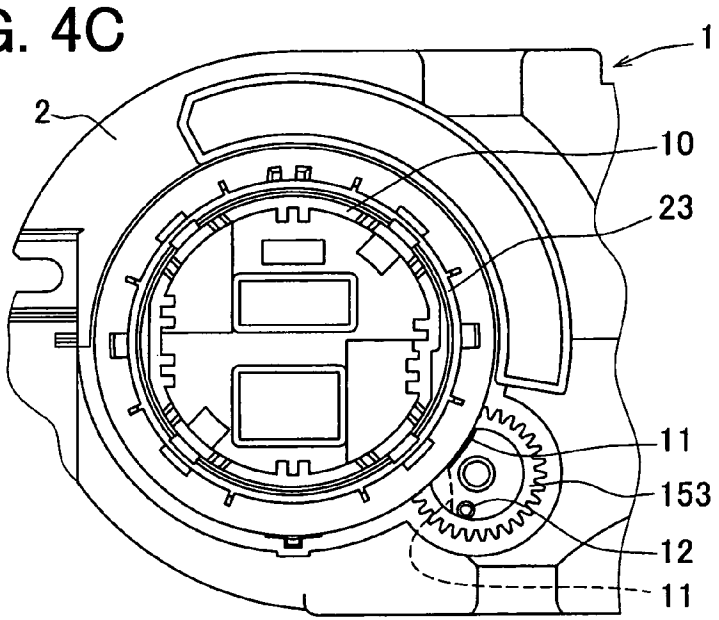
FIG. 4A-4D are drawings for explaining a function of a confirmation mark for detecting an incorrect engaging position of gears, wherein 4A and 4C are plan views and 4B and 4D are side views.
Figure 4A:
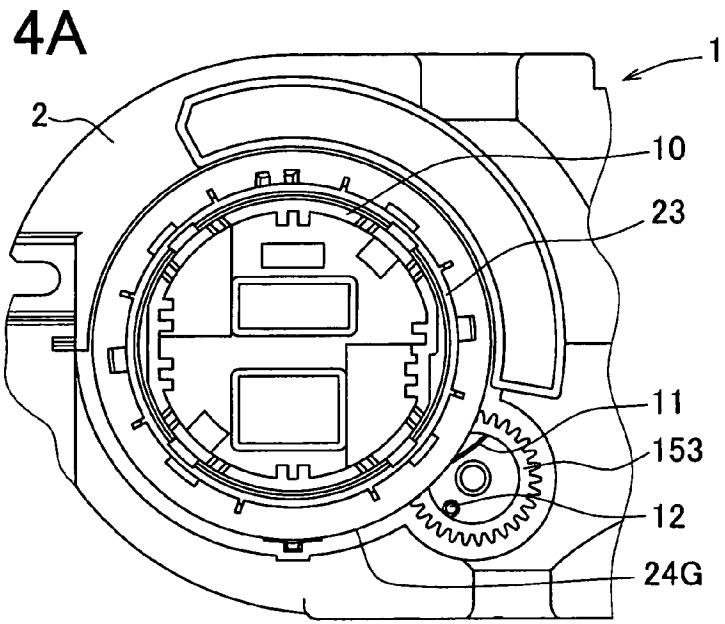
Figure 4D:
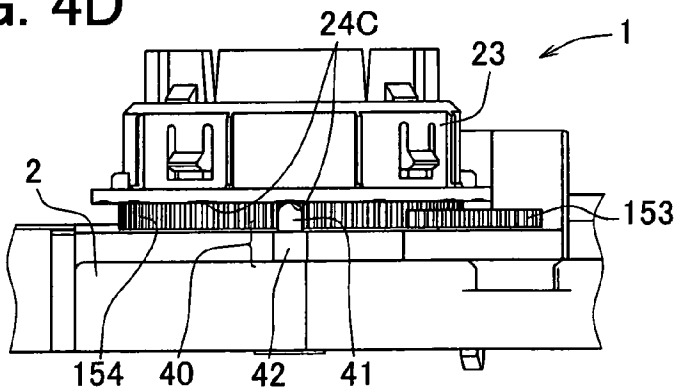
Figure 4B:
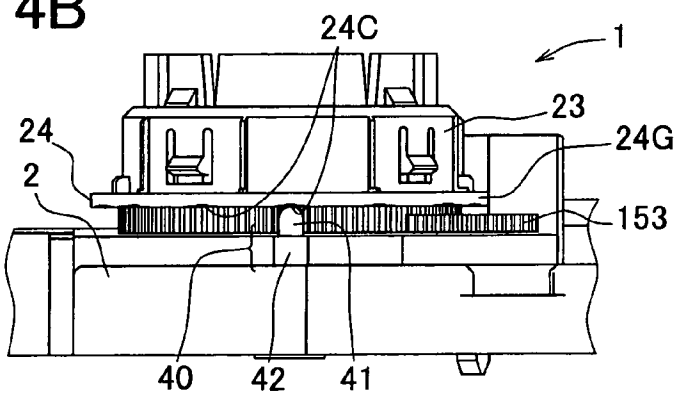

The function of the confirmation mark explained above will be further explained with reference to FIGS. 3A-3D and FIGS. 4A-4D. FIGS. 3A-3D show positions of the confirmation mark 11 when the gears 152, 153 are correctly engaged while FIGS. 4A-4D show those when the gears are not correctly engaged. FIGS. 3A and 3B show a position of the confirmation mark 11 when the dial member 23 is rotated rightward from the reference position to a position next to the reference position. The confirmation mark 11 is displaced considerably from the right position (the position exactly along the outer periphery 24G of the flange 24) because the dial member 23 is rotated more than two-tooth pitch of the first gear 152. FIGS. 3C and 3D show a position of the confirmation mark 11 when the dial member 23 is rotated leftward from the reference position to a position next to the reference position. The confirmation mark 11 is displaced considerably from the right position (the position exactly along the outer periphery 24G of the flange 24) because the dial member 23 is rotated more than two-tooth pitch of the first gear 152.

FIGS. 4A-4D show positions of the confirmation mark 11 when the first gear 152 is engaged with the second gear 153 at a position shifted from the right position by one-tooth pitch. In this case, the confirmation mark 11 is visible at the position shown in FIGS. 4A and 4B when the dial member 23 is at the reference position. If the dial member 23 is rotated leftward or rightward to positions next to the reference position, the confirmation mark 11 never comes accidentally to the right position (the position exactly along the outer periphery 24G) because the dial member 23 is rotated by more than two-tooth pitch. If the dial member 23 is rotated to forcibly bring the confirmation mark 11 to the right position, the projected portion 41 of the position holder 40 cannot rest in the depression 24C, rather it is positioned at an unstable position between neighboring depressions 24C. This means that the confirmation mark 11 cannot be brought to the correct position stably if the gears 152, 153 are not correctly engaged.

As explained above, it is easily found out whether the gears are correctly engaged or not based on the position of the confirmation mark 11 when the dial member 23 takes the reference position. In the process of assembling the first gear 152 and the second gear 153, the confirmation mark 11 is utilized to realize the correct engagement of the gears.

Figure 5:
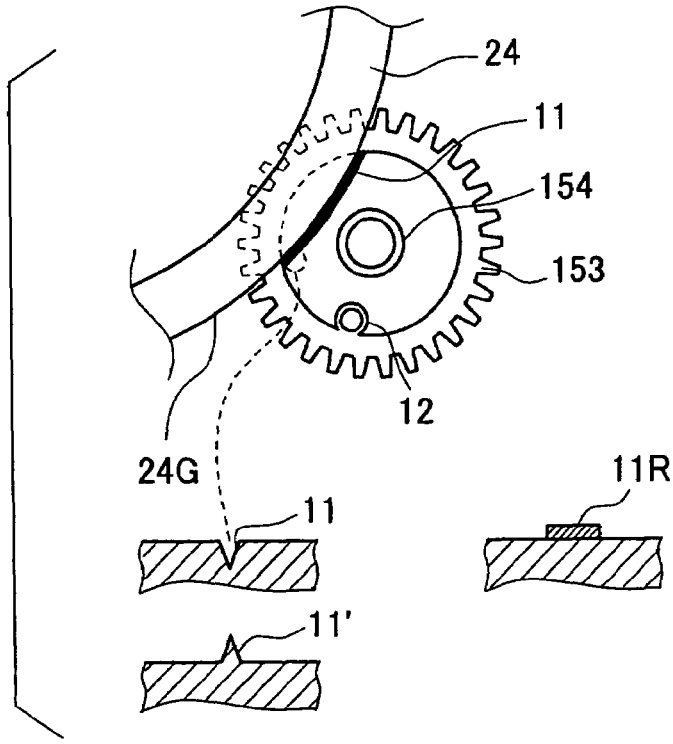
FIG. 5 is a plan view showing a confirmation mark as a first example, including cross-sectional views of the confirmation mark.

The confirmation mark 11 can be made in various forms. Some examples of the confirmation mark 11 are shown in FIGS. 5-9. Example 1 is shown in FIG. 5. In this example, the confirmation mark 11 is formed in a front surface of the second gear 153 in a form of a groove 11 or a rib 11'. If the second gear 153 is made of a resin material by injection molding, the groove 11 or the rib 11' may be integrally made with the second gear 153. Alternatively, the confirmation mark may be made in a form of a reflecting mark 11R. The reflecting mark 11R may be made of a metallic film or metallic coating so that light is reflected more on the reflecting mark 11R than on other places.

Figure 6:
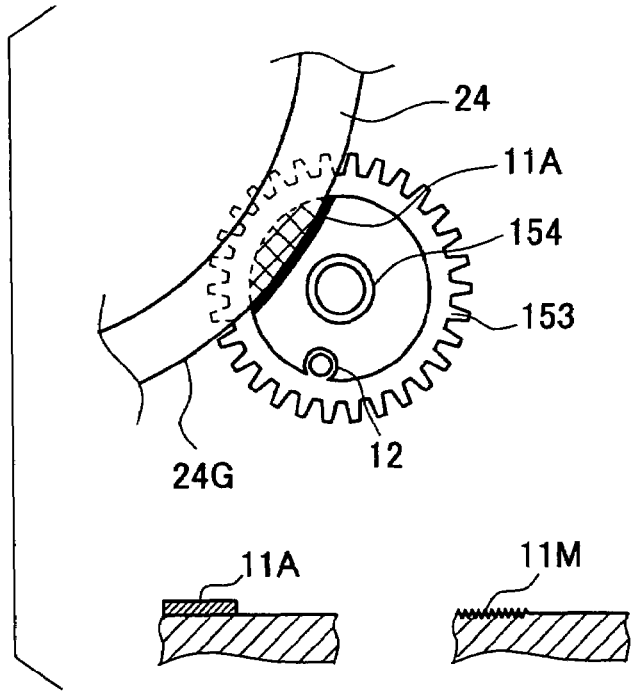
FIG. 6 is a plan view showing a confirmation mark as a second example, including cross-sectional views of the confirmation mark.

Example 2 is shown in FIG. 6. In this example, the confirmation mark is formed on a region of the front surface of the second gear 153, which is covered with the flange 24 when the dial member 23 is at the reference position and the gears 152, 153 correctly engage with each other. If the gears are not engaged at the correct position, the region forming the confirmation mark becomes visible from the front side. In this manner, whether the gears are correctly engaged is found out. The region forming the confirmation mark may be made as a reflecting mark 11A that reflects more light than other places or as a rough surface 11M that reflects less light than other places. Alternatively, the region forming the confirmation mark may be colored with paint.

Figure 7:
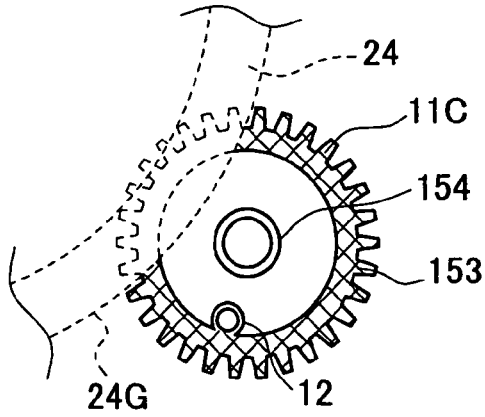
FIG. 7 is a plan view showing a confirmation mark as a third example.

Example 3 is shown in FIG. 7. The confirmation mark is formed on the teeth of the second gear 153 as a colored region 11C that is visible from the front side when the dial member 23 is at the reference position and the gears are correctly engaged. If the gears are not correctly engaged, gear teeth not colored become visible. The colored region 11C may be made by various methods such as painting or coating.

Figure 8:
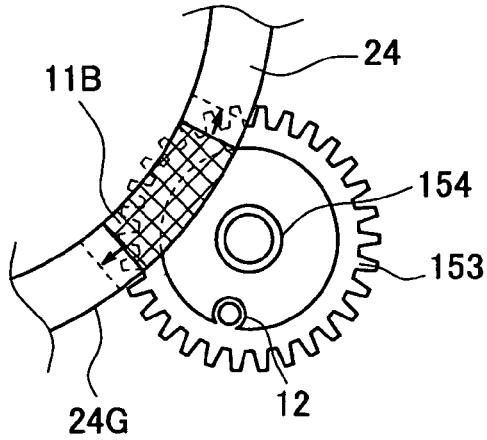
FIG. 8 is a plan view showing a confirmation mark as a fourth example.

Example 4 is shown in FIG. 8. In this example, the confirmation mark 11B is formed on the front surface of the flange 24 as a colored region or a reflecting region. If the gears 152, 153 are correctly engaged, the confirmation mark 11B is located exactly inside an inner circle of the gear teeth of the second gear 153 when the dial member 23 is at the reference position. On the other hand, if the gears are not correctly engaged, the confirmation mark 11B is shifted from the inner circle of the gear teeth.

Figure 9:
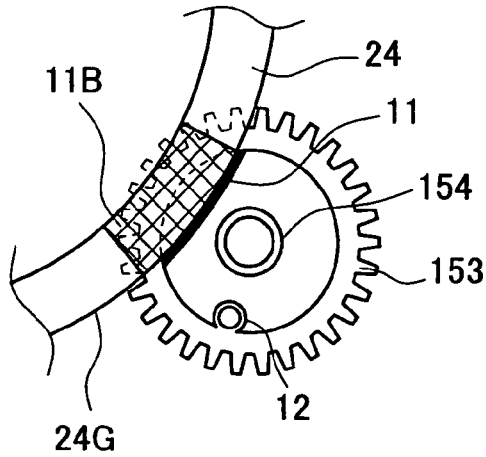
FIG. 9 is a plan view showing a confirmation mark as a fifth example.

Example 5 is shown in FIG. 9. In this example, the confirmation mark 11B is formed on the flange 24 in the same manner as in example 4, and the other confirmation mark 11 is formed on the front surface of the second gear 153 in the same manner as in example 1.

An auxiliary mark 12 may be formed on the second gear 153 in addition to the confirmation mark 11, as shown in FIGS. 5-9. A through-hole formed in the second gear 153 for inserting a jig therein in the assembling process of the gears may be used as the auxiliary mark 12. The auxiliary mark 12 is helpful to detect a position of the confirmation mark 11 more accurately by a photographical method.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A dial-type manipulator comprising:

a dial member having a first gear formed on an outer periphery thereof;

a second gear engaging with the first gear, the second gear having a rotational axis different from and parallel to a rotational axis of the first gear;

a detector for detecting a rotational position of the dial member, the detector being driven by the second gear;

a position holder for holding a rotational position of the first gear at least at a predetermined reference position; and a confirmation mark formed on either the second gear or the dial member, wherein:

the confirmation mark is visible in a predetermined state when the first gear is held at the reference position, if the first gear engages with the second gear at a predetermined correct rotational position.

2. The dial-type manipulator as in claim 1, wherein:

the confirmation mark is formed at a position that is visible from a front side of the dial member.

3. The dial-type manipulator as in claim 2, wherein:

the dial member includes a flange that makes the first gear and a portion of the second gear invisible from the front side of the dial member.

4. The dial-type manipulator as in claim 3, wherein:

the position holder holds the first gear at a plurality of rotational positions that are apart from one another by more than two-tooth pitch of the first gear.

5. The dial-type manipulator as in claim 1, wherein:

the confirmation mark is formed as a region having a light-reflecting rate different from that of other portions.

6. The dial-type manipulator as in claim 1, wherein:

the confirmation mark is formed as a colored region having a color different from that of other portions.

7. The dial-type manipulator as in claim 1, wherein:

an auxiliary mark is formed on either the second gear or the dial member at a position apart from the confirmation mark by a predetermined distance.

8. The dial-type manipulator as in claim 1 wherein the first gear is formed on a circumferential outer periphery of the dial member.

9. The dial-type manipulator as in claim 1 wherein the second gear is rotatable with respect to the first gear.

10. The dial-type manipulator as in claim 1 wherein the first gear is rotatable in a first direction and the second gear is rotatably driven by the first gear in a second direction opposite to the first direction.

11. A dial-type manipulator comprising:

a dial member having a first gear formed on an outer periphery thereof;

a second gear engaging with the first gear;

a detector for detecting a rotational position of the dial member, the detector being driven by the second gear;

a position holder for holding a rotational position of the first gear at least at a predetermined reference position; and a confirmation mark formed on either the second gear or the dial member, wherein:

the confirmation mark is visible in a predetermined state when the first gear is held at the reference position, if the first gear engages with the second gear at a predetermined correct rotational position;

the confirmation mark is formed at a position that is visible from a front side of the dial member;

the dial member includes a flange that makes the first gear and a portion of the second gear invisible from the front side of the dial member;

the position holder is formed on a base member rotatably supporting the dial member thereon; and the position holder resiliently engages with a depression formed on the flange to thereby hold the first gear at the reference position.

12. The dial-type manipulator as in claim 11, wherein:

the confirmation mark is formed on the second gear; and the confirmation mark is visible along an outer periphery of the flange when the first gear is held at the reference position, if the first gear engages with the second gear at a predetermined correct rotational position.

13. The dial-type manipulator as in claim 12, wherein:

the confirmation mark is a line mark.

14. The dial-type manipulator as in claim 11, wherein:

the second gear is made of resin by molding; and the confirmation mark is formed on the second gear in a shape of a groove or a rib.

15. The dial-type manipulator as in claim 11, wherein:

the confirmation mark is formed on the flange; and the confirmation mark entirely overlaps with a portion of the second gear when the first gear is held at the reference position, if the first gear engages with the second gear at a predetermined correct rotational position.

16. A dial-type manipulator comprising:

a dial member having a first gear formed on an outer periphery thereof;

a second gear engaging with the first gear;

a detector for detecting a rotational position of the dial member, the detector being driven by the second gear;

a position holder for holding a rotational position of the first gear at least at a predetermined reference position; and a confirmation mark formed on either the second gear or the dial member, wherein;

the confirmation mark is visible in a predetermined state when the first gear is held at the reference position, if the first gear engages with the second gear at a predetermined correct rotational position;

the confirmation mark is formed at a position that is visible from a front side of the dial member;

the dial member includes a flange that makes the first gear and a portion of the second gear invisible from the front side of the dial member;

the position holder holds the first gear at a plurality of rotational positions that are apart from one another by more than two-tooth pitch of the first gear; and a plurality of depressions with which the position holder engages are formed on the flange of the dial member.

* * * * *